US008967071B2

(12) United States Patent
Jarvis

(10) Patent No.: US 8,967,071 B2
(45) Date of Patent: Mar. 3, 2015

(54) GUIDE APPARATUS

(75) Inventor: Dwayne Jarvis, Allen, KY (US)

(73) Assignee: JTSR, LLC, Allen, KY (US)

( * ) Notice: Subject to any disclaimer, the term of this patent is extended or adjusted under 35 U.S.C. 154(b) by 293 days.

(21) Appl. No.: 13/606,151

(22) Filed: Sep. 7, 2012

(65) Prior Publication Data

US 2013/0055948 A1 Mar. 7, 2013

Related U.S. Application Data

(60) Provisional application No. 61/531,881, filed on Sep. 7, 2011.

(51) Int. Cl.
*E21F 17/18* (2006.01)
*E01F 9/00* (2006.01)

(52) U.S. Cl.
CPC .. *E01F 9/00* (2013.01); *E21F 17/18* (2013.01)
USPC ..... 116/63 R; 116/209

(58) Field of Classification Search
CPC ..... E01F 9/00; E01F 13/00; E21F 11/00; E21F 17/00; E21F 17/18; F16B 7/14; G09F 7/20
USPC ..... 40/617; 116/63 P, 63 R, 205, 209; 248/317, 320, 322, 323, 324, 326, 327, 248/333, 334.1, 335, 336, 337, 338, 339, 248/340, 343; 403/109.1, 109.2, 109.3, 403/109.5, 377; 439/477, 478
See application file for complete search history.

(56) References Cited

U.S. PATENT DOCUMENTS

| | | | | | |
|---|---|---|---|---|---|
| 237,287 | A | * | 2/1881 | Johnston | 248/337 |
| 257,781 | A | * | 5/1882 | Sullivan | 182/73 |
| 326,616 | A | * | 9/1885 | Woodbury et al. | 182/190 |
| 824,222 | A | * | 6/1906 | Warren | 439/478 |
| 1,454,753 | A | * | 5/1923 | McGhee | 246/473 R |
| 1,985,582 | A | * | 12/1934 | Schwinger | 248/343 |
| 2,576,005 | A | * | 11/1951 | Ferrary | 139/90 |
| 4,086,718 | A | * | 5/1978 | Swanson et al. | 43/17.2 |
| 4,218,157 | A | * | 8/1980 | Moxness | 404/6 |
| 5,011,319 | A | * | 4/1991 | Levi et al. | 403/109.5 |
| 5,230,296 | A | * | 7/1993 | Giltz et al. | 116/28 R |
| 5,297,500 | A | * | 3/1994 | Wilson | 116/28 R |
| 5,423,584 | A | * | 6/1995 | Pasternak | 294/19.2 |

(Continued)

FOREIGN PATENT DOCUMENTS

| | | | | | |
|---|---|---|---|---|---|
| CN | 202938817 | U | * | 5/2013 | G01C 5/00 |
| EP | 1038639 | A2 | * | 9/2000 | B25G 1/04 |

(Continued)

*Primary Examiner* — R. A. Smith
(74) *Attorney, Agent, or Firm* — Dinsmore & Shohl LLP

(57) ABSTRACT

Included are embodiments of a guide apparatus. In some embodiments, the guide apparatus includes a body portion, a connector housing, and a rounded connector portion. The connector housing may include a connector snap surface that is disposed on an interior surface of the connector housing. Additionally, the connector housing may define a hollow portion adjacent to the interior surface. The connector housing may be coupled to the body portion via the connector snap surface. Similarly, the rounded connector portion may be coupled to the connector housing and may removably secure to a spad that is disposed on a ceiling, such that the guide apparatus hangs substantially downward, regardless of the orientation of the spad. By hanging substantially downward, the retractable guide apparatus may more accurately identify an intended path within a mine shaft.

20 Claims, 11 Drawing Sheets

(56) References Cited

U.S. PATENT DOCUMENTS

| | | | | | |
|---|---|---|---|---|---|
| 5,460,458 | A | * | 10/1995 | Caceres | 403/109.5 |
| 5,474,016 | A | * | 12/1995 | Haney | 116/28 R |
| 5,474,274 | A | * | 12/1995 | Bernosky | 248/317 |
| 5,871,193 | A | * | 2/1999 | Jacobs et al. | 248/317 |
| 5,908,214 | A | * | 6/1999 | Dinardo | 294/19.2 |
| 5,988,101 | A | * | 11/1999 | Jacobs et al. | 116/205 |
| 6,045,288 | A | * | 4/2000 | Pasternak et al. | 403/109.3 |
| 6,148,760 | A | * | 11/2000 | Oi | 116/28 R |
| 8,422,716 | B2 | * | 4/2013 | Wetzel | 381/362 |
| 2003/0222189 | A1 | * | 12/2003 | Lee | 248/302 |

FOREIGN PATENT DOCUMENTS

| | | | | | |
|---|---|---|---|---|---|
| GB | 2383179 | A | * | 6/2003 | G09G 13/16 |
| WO | WO 9321448 | A1 | * | 10/1993 | F16B 7/14 |

* cited by examiner

GUIDE APPARATUS

CROSS REFERENCE

This application claims the benefit of U.S. Provisional Application No. 61/531,881, filed Sep. 7, 2011 which is incorporated by reference in its entirety.

BACKGROUND

1. Field

Embodiments provided herein generally relate to a mine guide apparatus, and particularly to an apparatus that attaches to a mine spad for identifying a boundary of a shaft or heading.

2. Technical Background

Mines such as coal mines may be created with a mine shaft or heading that spans a predetermined length into the mine and may have a relatively constant or varying height and width. Thus, depending on the particular mine, the mine shaft or heading may be sized to allow a drill or other vehicle to traverse the mine shaft or heading. Similarly, at times, the mine shaft or heading is too small to allow a vehicle to traverse the mine shaft or heading without utilizing a drilling tool to drill the desired material, such as coal, to open up the mine shaft or heading. Regardless, oftentimes the mine shaft or heading may run close to other deposits such as water, oil, natural gas, etc. or close to other mine shafts or headings. In such situations, a vehicle that inadvertently veers off course could collide with the deposit and/or other mine shaft or heading. If such a scenario occurs, not only could damage occur to the mine, but a dangerous situation may develop as well.

As such, mine workers oftentimes attempt to identify a desired mine path by using paint or other signifiers along the length of the mine shaft or heading. The signifier may be located on the ceiling of the mine and may allow a vehicle operator to traverse the mine shaft or heading without the risk of veering off course. However, applying the signifier may oftentimes also create a dangerous situation for mine workers. Specifically, a mine shaft or heading oftentimes includes a plurality of spads that are attached to the ceiling of the mine shaft or heading. The ceiling of the mine shaft or heading may range from about 3 feet to about 50 feet. As such, in many current solutions, the mine worker must climb up to the ceiling to attach a rod (that includes a hook) to the spads. As mine shafts and headings are often dark, the mine rods may provide a guide for a mine worker to create the signifier. However, as the ceilings are often out of reach for the mine worker, attaching the rods to the spads may create a dangerous situation for the mine worker.

SUMMARY

Included are embodiments of a guide apparatus. In some embodiments, the guide apparatus includes a body portion, a connector housing, and a rounded connector portion. The connector housing may include a connector snap surface that is disposed on an interior surface of the connector housing. Additionally, the connector housing may define a hollow portion adjacent to the interior surface. The connector housing may be coupled to the body portion via the connector snap surface. Similarly, the rounded connector portion may be coupled to the connector housing and may removably secure to a spad that is disposed on a ceiling, such that the guide apparatus hangs substantially downward, regardless of the orientation of the spad.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments disclosed herein include a guide apparatus with a rounded connector portion. Additionally, the guide apparatus may include a handle, an extender portion, and a connector housing. In some embodiments, the rounded connector portion may be magnetized to removably couple with a spad. Additionally, due to the rounded shape, the rounded connector portion may be configured to hang directly downward, regardless of the configuration of the spad, to indicate preferred direction within a mine shaft or heading. In some embodiments, the retractable guide apparatus may be fluorescent in color, may glow in the dark, may reflect light, and/or otherwise be easily detectable in low-light environments. In some embodiments, the retractable guide apparatus may be extendable and/or retractable such that the length of the retractable guide apparatus may vary based on an operator's discretion.

Figure 1:
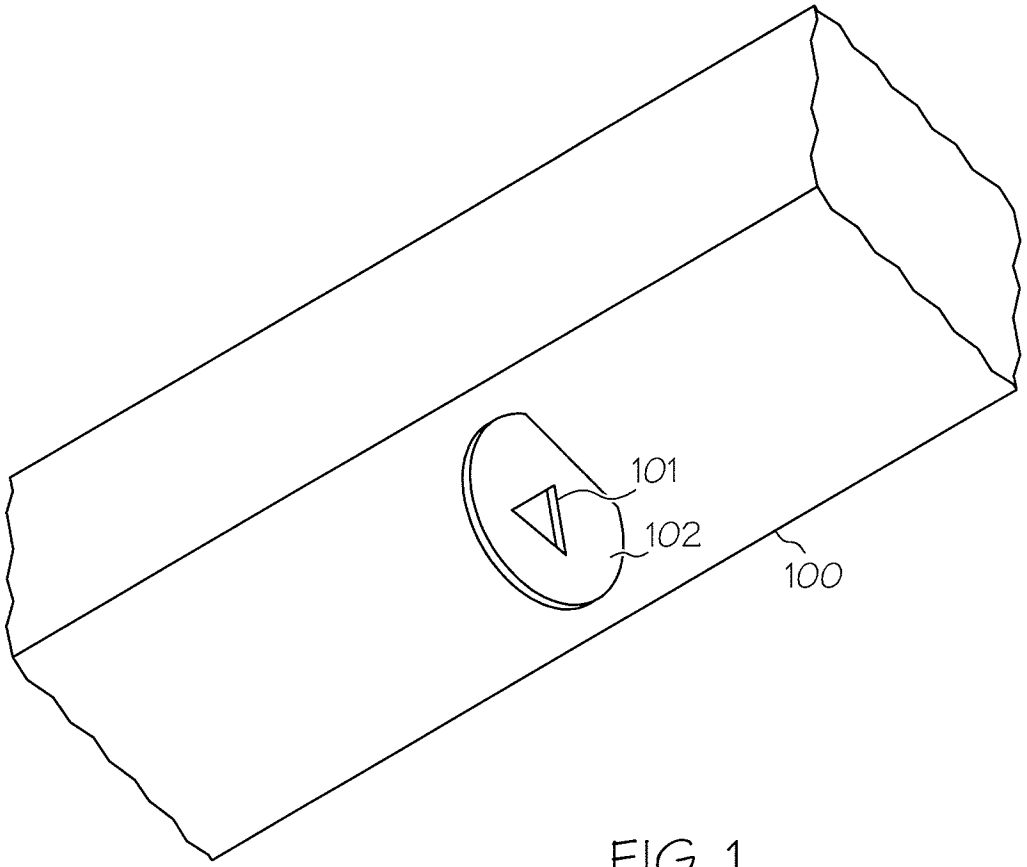
FIG. 1 PRIOR ART
FIG. 1 depicts a spad that has been driven into a wooden plug that is attached to a mine ceiling, according to one or more embodiments shown and described herein.

Referring now to the drawings, FIG. 1 depicts a spad 102 that has been driven into a wooden plug 100 that is attached to a mine ceiling, according to one or more embodiments shown and described herein. The visible portion of the spad 102 may be configured as a substantially circular or rounded disk shape with an aperture 101 in the center. The portion of the spad 102 that is driven into the wooden plug 100 may be configured as a screw, as a wedge, and/or as another configuration. While the spad 102 of FIG. 1 is depicted as being driven into the wooden plug 100 without bending, oftentimes, the spad 102 may be bent in use, during installation, and/or at other times. This may deform the spad 102, such that the lowest portion of the spad 102 may be directed at an angle other than directly downward.

Figure 2:
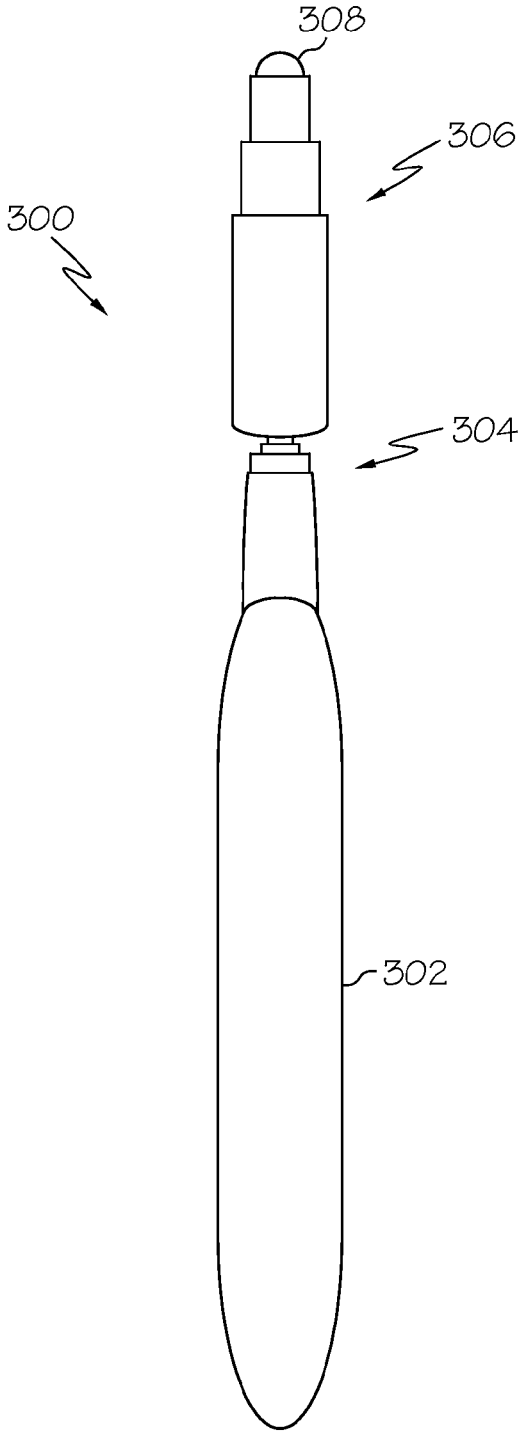
FIG. 2 depicts an embodiment of a retractable guide apparatus, according to embodiments shown and described herein.

FIG. 2 depicts an embodiment of a guide apparatus 300, according to embodiments shown and described herein. As illustrated, the guide apparatus 300 includes a handle 302, a body portion 304, a connector housing 306, and a rounded connector portion 308. As discussed above, the handle 302 may be constructed of a durable material, such as plastic, wood, rubber, metal, and/or other material. The handle 302 may be any color, but in some embodiments is of a fluorescent, reflective, and/or bright color to be visible in low-light environments.

Coupled to the handle 302 is the body portion 304. The body portion 304 may be a single piece, with a static length and/or may be configured as an extendable portion with a plurality of body links, which may be configured to extend and retract, such that the length of the guide apparatus 300 may be variable. The body portion 304 may be configured for a fully extended position, a fully retracted position, and/or other positions there between. The fully extended position may have a length that is longer than the fully retracted position. The body portion 304 may also take any length between the fully extended position and the fully retracted position. While in some embodiments, the body portion 304 may be embodied as an antenna style cascading metal portion, other embodiments need not be configured in this manner. In some embodiments, the body portion 304 may be configured as a plurality of rigid hinged portions that may be folded together or extended. As another example, the body portion 304 may be a rigid structure that may be rolled and unrolled for extension and retraction. Other configurations are also considered.

Also included is the connector housing 306. The connector housing 306 may be constructed of a plastic material, metal material, and/or other semi-rigid material for connecting the body portion 304 with the rounded connector portion 308. The connector housing 306 may be cylindrical, rectangular, and/or other shape and may or may not be hollow. Additionally, the connector housing 306 may couple to the rounded connector portion 308 such that the rounded connector portion 308 is secured at least partially inside the connector housing 306. Depending on the particular configuration, the rounded connector portion 308 may be rotatable within the connector housing 306; however this is not a requirement.

It should also be understood that the rounded connector portion 308 may be constructed in any shape, such as spherical, cylindrical, and/or other regular or non-regular shape. However, in at least one embodiment, the portion of the rounded connector that extends beyond the end of the connector housing 306 may be rounded. Further, the rounded connector portion 308 may be constructed of magnetic material, adhesive, and/or other material that easily attracts and/or attaches to the spad 102 without having to insert any portion of the retractable guide device inside the aperture 101. Because the spad 102 may be made of a metallic material, utilizing a magnetic material for the rounded connector portion 308 may provide the desired functionality. With that said, an adhesive and/or other mechanism for connecting the rounded connector portion 308 may be utilized.

Figure 3:
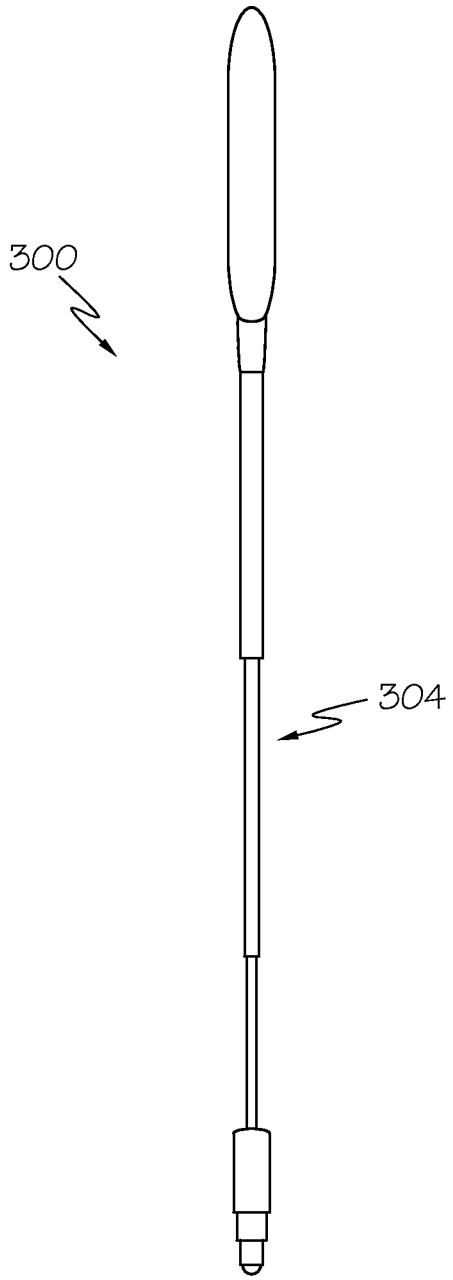
FIG. 3 depicts the retractable guide apparatus in a fully extended position, according to embodiments shown and described herein.

FIG. 3 depicts the guide apparatus 300 that is fully extended, according to embodiments shown and described herein. As described above, the body portion 304 of the guide apparatus 300 may be configured for extension and/or retraction. In the embodiment depicted in FIG. 3, the body portion 304 is fully extended. By fully extending the guide apparatus 300, the operator may be able to reach a spad 102 that is connected to a mine ceiling that of an elevation that is not easily reachable, unless the guide apparatus 300 is fully extended. Fully extending the guide apparatus 300 may reduce risks to the operator because the operator need not climb onto other objects to attach the guide apparatus 300 to a spad 102, which may be mounted to a mine ceiling.

Figure 4:
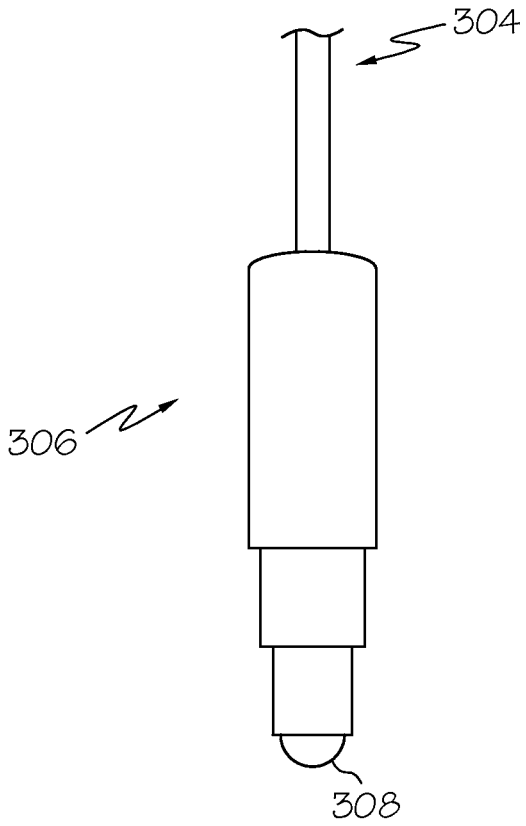
FIG. 4 depicts a fully extended retractable guide apparatus, according to embodiments shown and described herein.

FIG. 4 depicts a side view of the connector housing 306 of the guide apparatus 300 as shown in FIG. 3, according to embodiments shown and described herein. As illustrated, the connector housing 306 may be configured to secure both the body portion 304, as well as the rounded connector portion 308. Depending on the particular embodiment, either or both of these connections may be removably secured, such that an operator may disassemble the guide apparatus 300 for storage, part replacement, etc.

As discussed above, the guide apparatus 300 may be configured such that at least a portion of the rounded connector portion 308 extends beyond an edge of the connector housing 306. Similarly, some embodiments are configured such that the rounded connector portion 308 is fully within the connector housing 306. Thus, such embodiments may be configured with the connector housing 306 that includes an open end, a closed end, or a partially closed end. Additionally, while the rounded connector portion 308 may be of any shape. The portion that extends beyond the edge of the connector housing 306 (or otherwise connects with the spad 102) may be rounded to allow the guide apparatus 300 to hang substantially downward, regardless of the condition and/or position of the spad 102.

Figure 5:
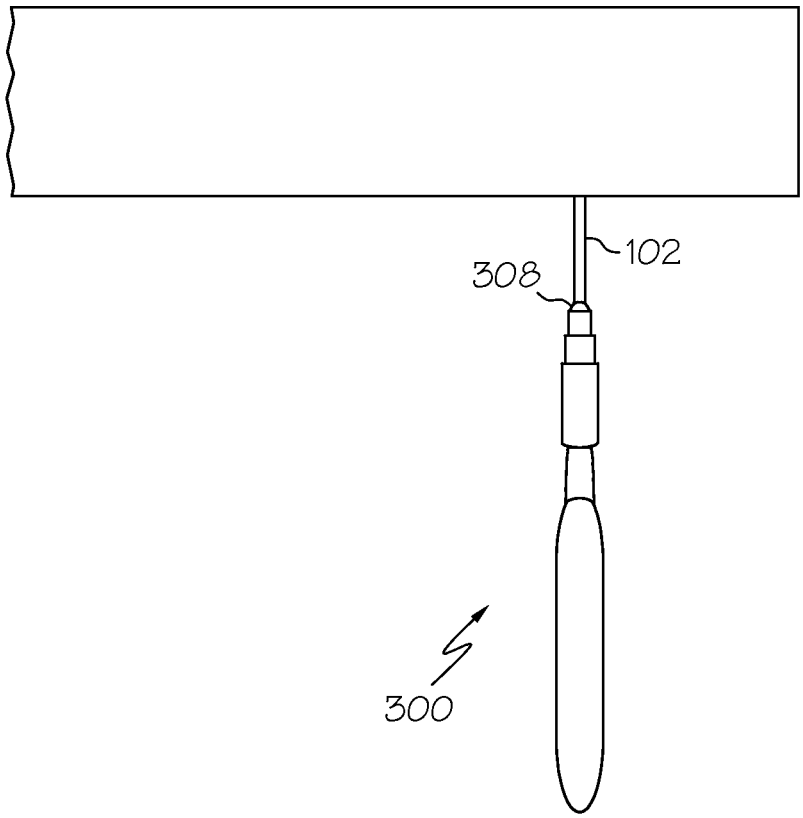
FIG. 5 depicts the retractable guide apparatus removably attached to a spad, according to embodiments shown and described herein.

FIG. 5 depicts the guide apparatus 300 removably attached to a spad 102, according to embodiments shown and described herein. As illustrated, due to the rounded nature of the rounded connector portion 308, the guide apparatus 300 may hang substantially downward, regardless of the orientation of the spad 102. By hanging substantially downward, the guide apparatus 300 may more accurately identify an intended path within the mine shaft or heading. Additionally, attachment and removal of the guide apparatus 300 may be easier than if the guide apparatus 300 does not hang substantially downward.

Figure 6:
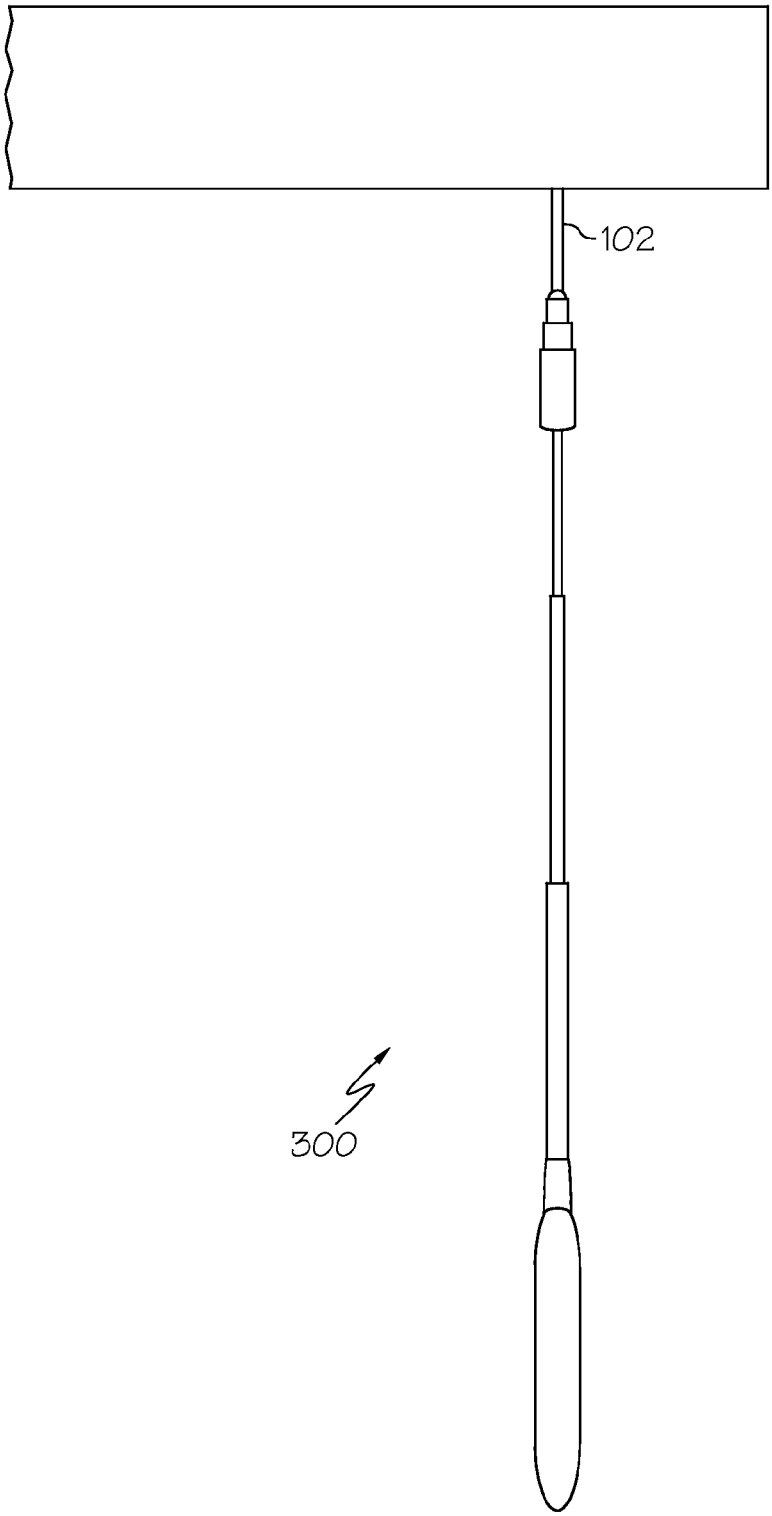
FIG. 6 depicts the retractable guide apparatus fully extended and removably attached to a spad, according to embodiments shown and described herein.

FIG. 6 depicts the guide apparatus 300 fully extended and removably attached to a spad, according to embodiments shown and described herein. As illustrated, while the embodiment of FIG. 5 illustrates the guide apparatus 300 in a retracted position, the embodiment of FIG. 6 is depicted in a fully extended position. Such a configuration may allow an operator to reach the spad 102 that is located at an elevated location, without the necessity of a ladder or other assistance. Thus, the operator may fully extend the guide apparatus 300, attach the guide apparatus 300 to the spad 102 and then partially (or fully) retract the guide apparatus 300, so that the guide apparatus 300 is of a predetermined length, based on the ceiling height.

Figure 7:
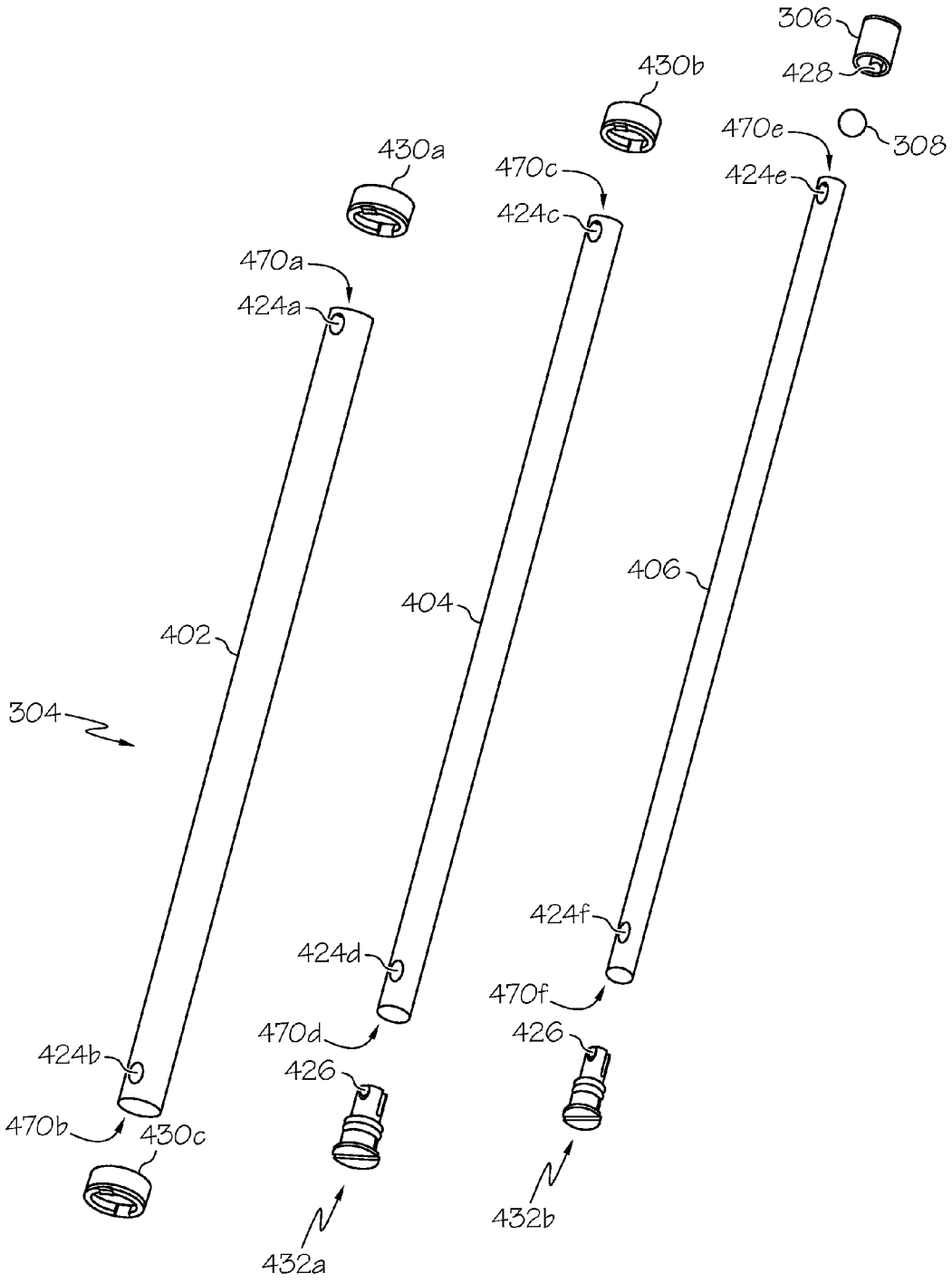
FIG. 7 depicts an exploded view of the retractable guide apparatus, according to embodiments shown and described herein.

FIG. 7 depicts an exploded view of the guide apparatus 300, according to embodiments shown and described herein. The body portion 304 of the guide apparatus 300 includes a plurality of body links 402, 404, 406, which are configured such that a first adjacent body link may slide within a second adjacent body link. In such an embodiment, the plurality of body links includes a first body link 402, a second body link 404, and a third body link 406. While in some embodiments, the body links 402, 404, 406 may be solid pieces that are hinged on opposing ends to provide the variable length, in some embodiments, the body links may be configured as hollow tubes. Thus, as depicted, the first body link 402 may be hollow and may have a diameter of the hollow portion that is of a length to allow the second body link 404 to slide within the first body link 402. Further, the second body link may also be hollow and the hollow portion may have a diameter that is of a length to allow the third body link 406 to slide within the second body link 404.

The plurality of body links 402, 404, 406 may be slidably connected via a plurality of collars 430*a*, 430*b*, 430*c* (collectively referred to as "collars 430") and a plurality of couplers 432*a*, 432*b*, 432*c* (collectively referred to as "couplers 432"), at respective body link ends 470*a*-470*f* (collectively referred to as "body link ends 470"), as shown in greater detail below in FIG. 8 and FIG. 9. The collars 430 may be hollow and the hollow portion may have an inside diameter that corresponds with the outside diameter of the respective body links 402, 404, 406. Thus, the hollow portion of the collars 430 may be sized such that the collars 430 may couple with the respective body link 402, 404, 406. Specifically, the body links 402, 404, 406 may include one or more snap apertures 424*a*-424*f* (referred to herein as "snap apertures 424") for securing the collars 430 and/or couplers 432, and thereby securing the body links as described in more detail below.

For example, a first collar 430*a* may be hollow and thus have an inside diameter that substantially matches the outside diameter of the first body link 402. A second collar 430*b* may be hollow and have an inside diameter that substantially matches the outside diameter of the second body link 404. A third collar 430*c* may be attached to the first body link 402 at the opposite end of the first collar 430*a* and may be hollow and sized to secure the body portion 304 to the handle 302. The collar 430 defines an interior portion which may be equivalent to the hollow of 430*a*-430*c*.

The couplers 432 are also included in the embodiment of FIG. 7. The couplers 432 may include a snap surface 426 that fits into a snap aperture 424. The combination of the snap surface 426 and the snap aperture 424 may be used to attach the plurality of body links 402, 404, 406 together to form the body portion 304.

Also included in FIG. 7 are the connector housing 306, the rounded connector portion 308, and connector snap surface 428. The rounded connector portion 308 is inserted into the connector housing 306. The connector housing 306 includes a connector snap surface 428 which facilitates a connection between the connector housing 306 and the snap aperture 424*e* to retain the rounded connector portion 308 within the connector housing 306, as well as secure the connector housing 306 to the third body link 406.

Figure 8:
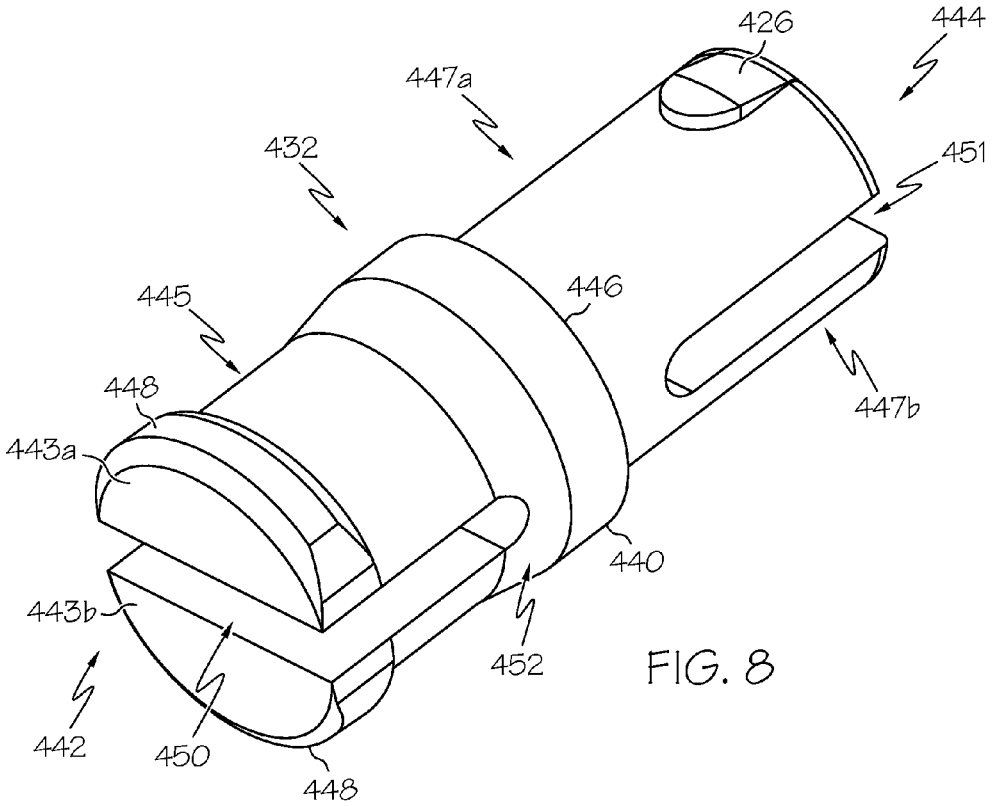
FIG. 8 is a perspective view of a coupler, according to embodiments shown and described herein.

FIG. 8 is a perspective view of the coupler 432, according to embodiments shown and described herein. The coupler 432 includes a flex fitting portion 442 for removably securing the coupler 432 to a larger body link. Specifically, the flex fitting portion 442 may be divided into a first section 443*a* and a second section 443*b*, which defines a slot opening 450 separating the first section 443*a* and the second section 443*b*. The flex fitting portion 442 may also be configured with a plurality of ridges 448 that is slightly larger the remaining section 445 of the flex fitting portion 442. A tapered surface 452 may also be included for providing a stopping point for the body link 402, 404, 406.

To insert the flex fitting portion 442 into one of the body links 402, 404, 406, the first section 443*a* and the second section 443*b* may be pressed together to compress the slot opening 450. With the first section 443*a* and the second section 443*b* are pressed together, the plurality of ridges 448 may be inserted into the body link 402, 404, 406. The first section 443*a* and the second section 443*b* may provide a biasing force that creates a friction fit between the body link 402, 404, 406 and the plurality of ridges 448. The friction fit may allow the coupler 432 to be removed by an application of force without the need for tools.

Also included in FIG. 8 is a snap fitting portion 444 that may also be utilized to connect with one of the body links 402, 404, 406. The snap fitting portion 444 includes a snap surface 426 for securing the snap fitting portion 444 with a body link 402, 404, 406, as well as a first connection portion 447*a* and a second connection portion 447*b*, which define a snap slot opening 451 for providing a flexible section for inserting the coupler 432 into one of the body links 402, 404, 406. Additionally included are an alignment ring 440 with a stop surface 446 and the tapered surface 452.

To insert the snap fitting portion 444 into a body link 402, 404, 406, the operator (and/or assembler) may press the first connection portion 447*a* and the second connection portion 447*b* together to compress the snap fitting portion 444. With the first connection portion 447*a* and the second connection portion 447*b* pressed together, the snap fitting portion may be inserted into the body link 402, 404, 406. When the snap surface 426 is aligned with the snap aperture 424 of the body link 402, 404, 406 (FIG. 7), the slot opening 450 may provide a biasing force to keep the snap surface 426 within the snap aperture 424.

As discussed above, the alignment ring 440 includes a stop surface 446 and a tapered surface 452. The stop surface 446 may provide a stopping point for the body link 402, 404, or 406 to rest against and provide an indication when the body link 402, 404, 406 is fully seated on the coupler 432. The tapered surface 452 may be tapered and/or configured as a stop surface and may provide the stopping point for the connection of another body link 402, 404, 406 when connected via the flex fitting portion 442. As the body link 402, 404, or 406 is pressed against the tapered surface 452, it may provide a biasing force to center the body link 402, 404, 406 on the coupler 432 and provide another friction fit to help retain the body link 402, 404, 406 on the coupler 432. By centering the body link 402, 404, 406 on the coupler 432, the tapered surface 452 enables two of the body links 402, 404, 406 that are connected to the coupler 432 to remain aligned through the use of the guide apparatus 300.

Figure 9:
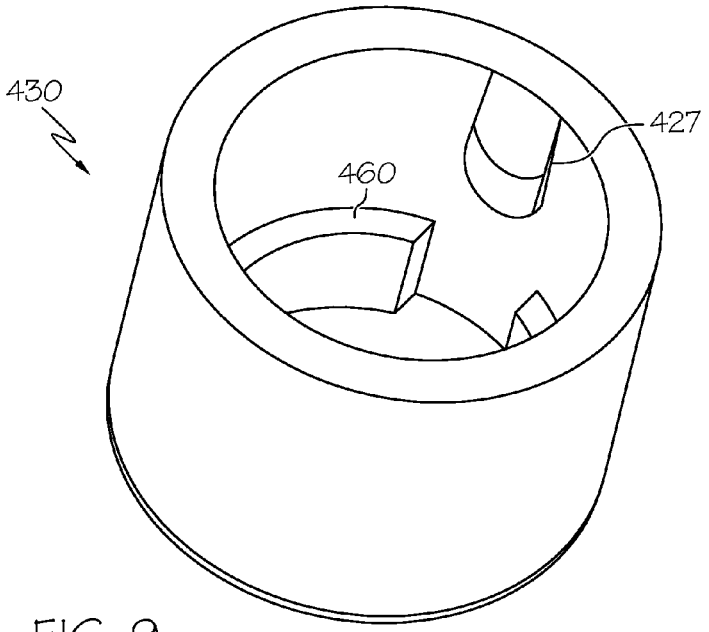
FIG. 9 depicts a perspective view of a collar, according to embodiments shown and described herein.

FIG. 9 depicts a perspective view of the collar 430, according to embodiments shown and described herein. The collar 430 includes a sliding surface 460 and a collar snap surface 427. The collar snap surface 427 snaps into the snap aperture 424 of the plurality of body links to hold it in place. The sliding surface 460 may narrow a portion of an inner diameter of the collar 430, such that an inner diameter of the sliding surface 460 substantially matches an outside diameter of the body link 402, 404, 406 with which the collar 430 is connecting. When the collar 430 is secured into place (e.g., the collar snap surface 427 is positioned within the snap aperture 424), the sliding surface 460 is positioned over an end of the body link 402, 404, 406. This increases the friction fit of the coupler 432 to ensure the plurality of body links 404, 404, 406 maintain secured and aligned.

Figure 10:
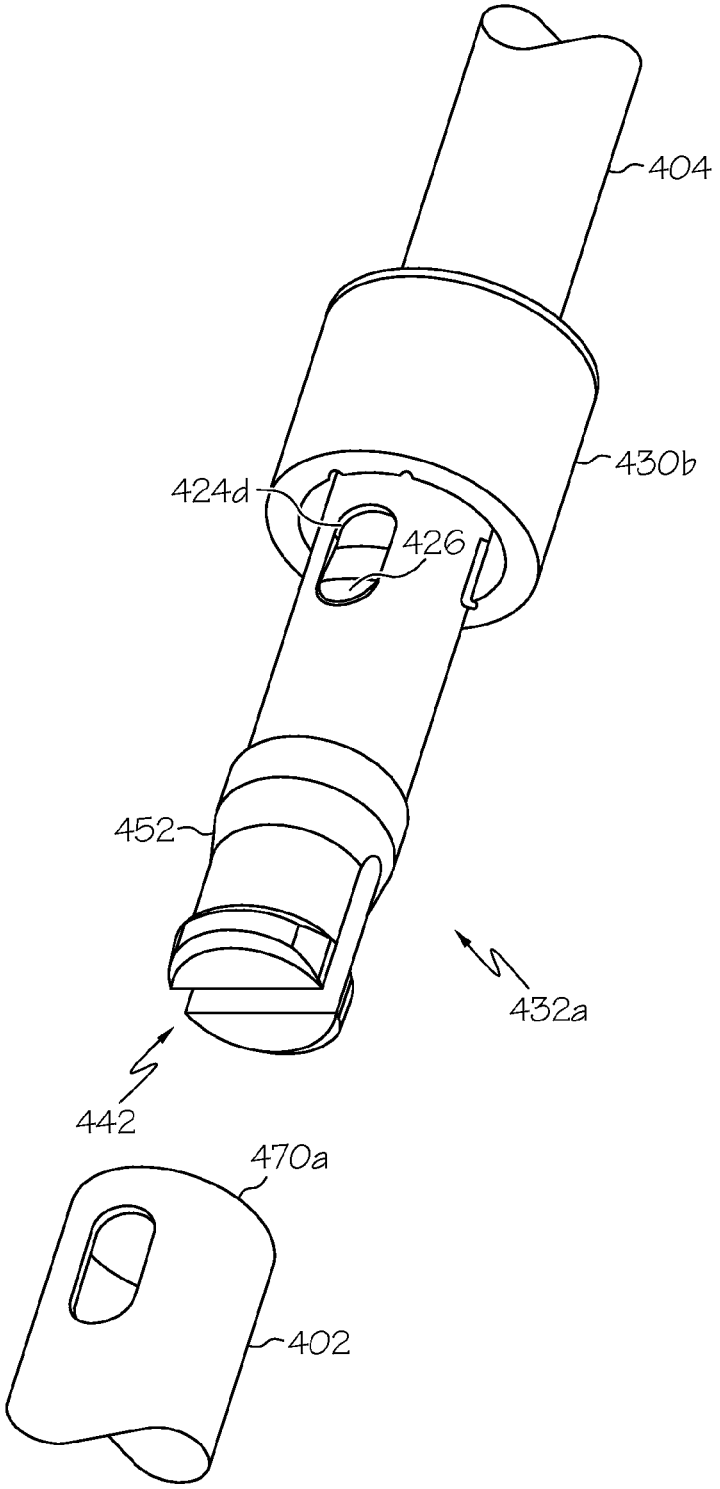
FIG. 10 depicts a perspective view of the connection of two body links, according to embodiments shown and described herein.

FIG. 10 depicts a perspective view of the connection of two body links 402, 404, according to embodiments shown and described herein. The coupler 432*a* is inserted into the second body link 404 until the snap surface 426 snaps into the snap aperture 424*d* to secure the coupler 432*a* to the second body link 404. The flex fitting portion 442 of the coupler 432*a* is inserted into the body link end 470 of the first body link 402 until the body link end 470 is seated against the tapered surface 452 of the coupler 432*a*. The first collar 430*a* may be coupled to the body link 404 such that the first collar 430*a* is seated in the snap aperture 424*d*. The first collar 430*a* covers the body link end 470.

Figure 11:
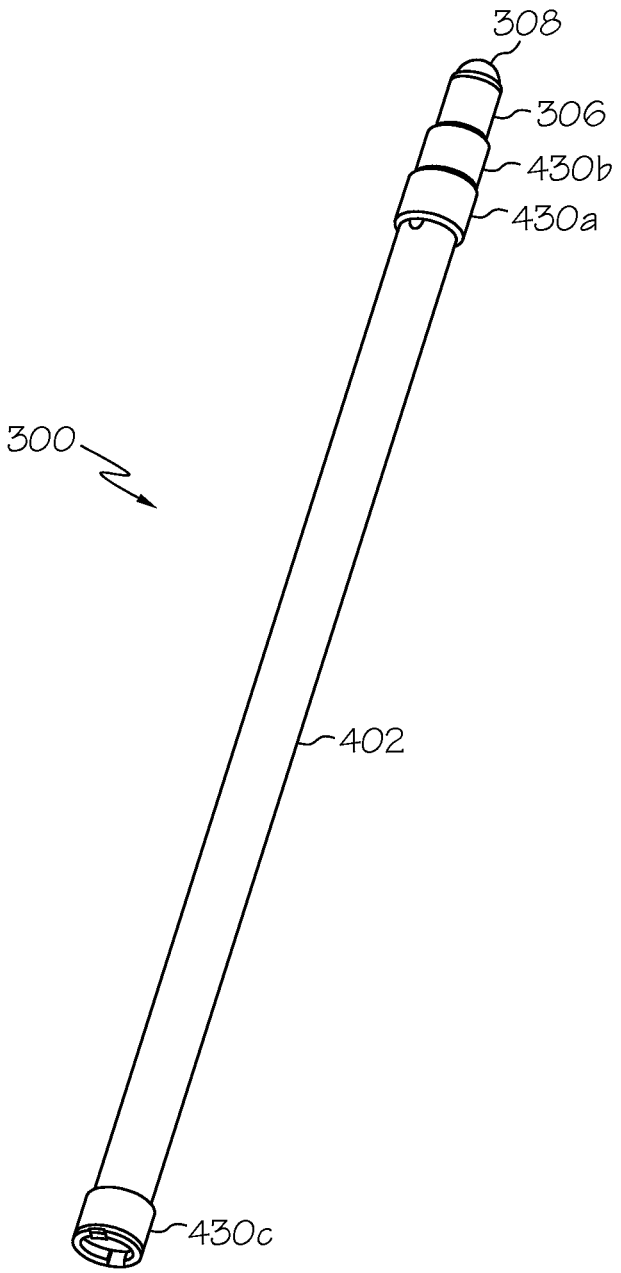
FIG. 11 depicts a perspective view of the retractable guide apparatus fully retracted, according to embodiments shown and described herein.

FIG. 11 depicts a perspective view of the guide apparatus 300 fully retracted, according to embodiments shown and described herein. The connector housing 306 secures the rounded connector portion 308 to the guide apparatus 300. The first body link 402 is visible in FIG. 11, while the second body link 404 and the third body link 406 being disposed within the first body link 402, with the collars 430 being visible.

Figure 12:
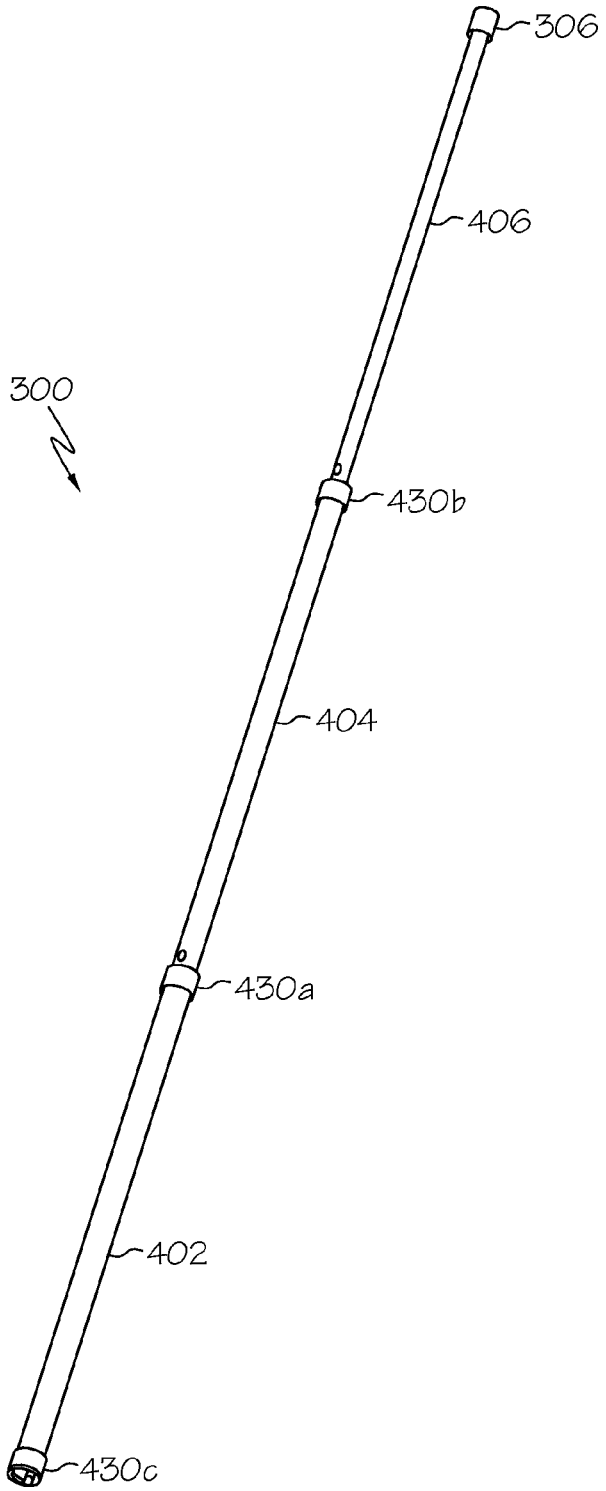
FIG. 12 depicts a perspective view of the retractable guide apparatus fully extended, according to embodiments shown and described herein.

FIG. 12 depicts a perspective view of the guide apparatus 300 fully extended, according to embodiments shown and described herein. All three body links 402, 404, and 406 are visible. The collars 430 are also visible and in conjunction with the plurality of couplers (not shown), aid the guide apparatus 300 to remain rigid in the fully extended position.

The guide apparatus 300 may be partially extended depending on the height of the spad 102. The snap surface 426 may be configured as a ball bearing and/or a rod that is biased against a spring and/or surface internal to the body link 402, 404, or 406. The coupler 432 may connect to the body link 402, 404, 406 via a twist lock, an internal elastic band, or other device for biasing the body link sections together. Further, the disclosure is not limited to the use of the body links 402, 404 and 406. Additional body links, collars, and couplers may be added to make the body portion 304 longer in length than as shown in FIG. 12.

It should be understood that in some embodiments, the guide apparatus 300 may be configured with a light source to illuminate an area that the guide apparatus 300 is being used. The light source may be located on the handle 302, on the connector housing 306, on the body portion 304, and/or elsewhere to provide the desired functionality.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

As discussed above, embodiments disclosed herein allow a user to attach a guide apparatus to a spad without the use of a ladder or other assistance. Additionally, embodiments disclosed herein may be configured to hang in a substantially downward position, regardless of spad condition and/or position.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A guide apparatus comprising:

an extendable portion of a variable length, wherein the extendable portion comprises a first body link, a second body link, a coupler, and a first collar, wherein the coupler and the first collar connect the first body link to the second body link to provide for the variable length, wherein the coupler comprises a flex fitting portion and a snap fitting portion, the snap fitting portion being disposed opposite the flex fitting portion, wherein the snap fitting portion includes a snap surface for engaging the first body link and the flex fitting portion includes a ridge for engaging the second body link, and wherein the first collar comprises a sliding surface and a collar snap surface that are disposed on an interior portion of the first collar and engage with the coupler;

a connector housing that comprises a connector snap surface that is disposed on an interior surface of the connector housing, wherein the connector housing defines a hollow portion adjacent to the interior surface, and wherein the connector housing is coupled to the extendable portion via the connector snap surface; and a rounded connector portion secured partially within the hollow portion of the connector housing and extending beyond an edge of the connector housing, wherein the rounded connector portion comprises a magnetic material configured to magnetically engage with a spad that is attached to a ceiling, wherein the rounded connector portion causes the guide apparatus to hang substantially downward, regardless of an orientation of the spad.

2. The guide apparatus of claim 1, further comprising a handle coupled to the extendable portion opposite the connector housing.

3. The guide apparatus of claim 2, wherein the handle is coupled to the first body link via a second collar.

4. The guide apparatus of claim 1, wherein the extendable portion configured as a cascading metal portion, that provides the first body link to reside within a hollow portion of the second body link when the extendable portion is retracted.

5. The guide apparatus of claim 1, wherein the first body link and the second body link comprise a snap aperture for receiving the coupler.

6. The guide apparatus of claim 1, wherein the flex fitting portion further comprises a tapered surface for engaging the first body link.

7. The guide apparatus of claim 1, wherein the snap fitting portion further comprises a stop surface for engaging the second body link.

8. A guide apparatus comprising:

a handle;

a body portion that is coupled to the handle, via a collar;

a connector housing that comprises a connector snap surface that is disposed on an interior surface of the connector housing, wherein the connector housing defines a hollow portion adjacent to the interior surface, and wherein the connector housing is coupled to the body portion via the connector snap surface; and a rounded connector portion secured at least partially within the hollow portion of the connector housing wherein the rounded connector portion is configured to removably secure to a spad that is disposed on a ceiling, wherein the rounded connector portion causes the guide apparatus to hang substantially downward, regardless of an orientation of the spad.

9. The guide apparatus of claim 8, wherein the body portion is configured as an extendable portion with a variable length.

10. The guide apparatus of claim 9, wherein the body portion comprises a first body link and a second body link, wherein the first body link is sized to fit within a hollow portion of the second body link.

11. The guide apparatus of claim 9, wherein the body portion comprises a first body link and a second body link that are hinged together.

12. The guide apparatus of claim 8, wherein the rounded connector portion is constructed of at least one of the following: a magnetic material and an adhesive.

13. The guide apparatus of claim 8, wherein the body portion comprises a snap aperture for engaging the rounded connector portion.

14. The guide apparatus of claim 8, further comprising the spad.

15. A guide apparatus comprising:

a body portion;

a connector housing coupled to the body portion, the connector housing comprising a connector snap surface that is disposed on an interior surface of the connector housing, wherein the connector housing defines a hollow portion adjacent to the interior surface, and wherein the connector housing is coupled to the body portion via the connector snap surface; and a rounded connector portion coupled to the connector housing, wherein the rounded connector portion is configured to removably secure to a spad that is disposed on a ceiling, wherein the rounded connector portion causes the guide apparatus to hang substantially downward, regardless of an orientation of the spad.

16. The guide apparatus of claim 15, further comprising a handle coupled to the body portion.

17. The guide apparatus of claim 15, wherein the body portion is configured as an extendable portion with a variable length.

18. The guide apparatus of claim 17, wherein the body portion comprises a first body link and a second body link, wherein the first body link is sized to fit within a hollow portion of the second body link.

19. The guide apparatus of claim 17, wherein the body portion comprises a first body link and a second body link that are hinged together.

20. The guide apparatus of claim 15, further comprising the spad.

* * * * *